United States Patent [19]

Goldhaber

[11] 4,175,357

[45] Nov. 27, 1979

[54] PROTECTIVE ENCLOSURE FOR BUILDING OPENINGS

[76] Inventor: Marvin L. Goldhaber, 1005 Talbot, Huntington Woods, Mich. 48070

[21] Appl. No.: 578,083

[22] Filed: May 16, 1975

Related U.S. Application Data

[63] Continuation-in-part of Ser. No. 423,273, Dec. 10, 1973, Pat. No. 3,978,614.

[51] Int. Cl.[2] ..... E05C 9/00; E06B 3/30; E06B 7/00

[52] U.S. Cl. ..... 49/395; 49/56; 49/67; 49/397; 49/401; 52/202

[58] Field of Search ..... 49/56, 50, 61, 63, 62, 49/67, 463, 394, 395, 397, 400, 401, 402, 380, 381; 52/202

[56] References Cited

U.S. PATENT DOCUMENTS

| | | | |
|---|---|---|---|
| 948,628 | 2/1910 | Jefferis | 49/395 |
| 2,711,565 | 6/1955 | Levin | 49/56 X |
| 2,845,665 | 8/1958 | Place | 49/397 |
| 3,381,416 | 5/1968 | Torres et al. | 52/202 X |

FOREIGN PATENT DOCUMENTS

| | | | |
|---|---|---|---|
| 486426 | 5/1938 | United Kingdom | 49/401 |
| 619901 | 3/1949 | United Kingdom | 49/401 |

*Primary Examiner*—Philip C. Kannan
*Attorney, Agent, or Firm*—Basile and Weintraub

[57] ABSTRACT

A protective enclosure for building openings such as windows and doorways wherein the protective enclosure comprises a peripheral frame member that circumscribes the openings and pivotally mounts a transparent shielding unit. The unit which may function as a window or door, depending upon the application, is provided with a unique hinge and locking arrangement which facilitates the easy opening and closing of the unit with respect to the opening; yet one which provides security against the unauthorized entry through the opening in that the unit may not be removed from the building opening from the outside of the building when the unit is in a closed position.

4 Claims, 8 Drawing Figures

PROTECTIVE ENCLOSURE FOR BUILDING OPENINGS

CROSS REFERENCE TO RELATED APPLICATIONS

The present patent application is a continuation-in-part application of co-pending U.S. patent application Ser. No. 423,273 filed on Dec. 10, 1973, for a "CASEMENT COVERING" now U.S. Pat. No. 3,978,614.

BACKGROUND OF THE INVENTION

I. Field of the Invention

The present invention relates to protective enclosures for building openings and, more particularly, the present invention relates to door and window coverings comprising substantially shatter-resistant glazing enclosed by metal frames and secured to the window and door openings in such a manner that they may not be readily removed from the outside.

II. Description of the Prior Art

Buildings and, in particular, homes present an attractive target for burglars and other persons attempting illegal entry into such buildings. The problem is particularly acute in urban areas where large numbers of buildings are involved over a wide area, and the buildings are uninhabited.

Heretofore it has been suggested that the aforementioned problem may be overcome by one of several methods. The obvious method would comprise the placement of guards in such buildings; however, when the buildings involved are uninhabited residential homes, the use of guards becomes a very expensive and impractical solution. The second method of protecting vacant buildings is to utilize burglar alarms. However, burglar alarms do permit an illegal entrant to gain access to the interior of the building; and while he may be deterred subsequently because of the internally generated alarm or the rapid approach of the police or other security officials, such an illegal entry has already been committed and would more than likely result in at least damage to the window or door utilized to gain entry. In the event that the alarm system doesn't properly function and no alarm is given, then the burglar would be able to cause considerable damage and/or cost to the building owner.

As a practical matter abondoned homes in large urban areas are protected against illegal entry by boarding up the windows and doors of such uninhabited or abandoned buildings. The obvious difficulty with this solution, as pointed out in the aforementioned co-pending U.S. patent application, is that it is very easy for a determined burglar or other illegal entrants to simply remove the boards and enter the building. This can be accomplished by the use of any convenient tools such as a hammer or the like.

In addition to providing a means for preventing entry into an abondoned or unoccupied building, many homes are vacated on a temporary basis such as when the building owners leave their buildings for the purpose of taking a brief vacation. Many building owners cannot afford expensive and elaborate burglar-alarm systems, nor can they afford to hire guards to stand on the premise during their absence. It would therefore be desirable to provide a protective enclosement of buildings, such as homes, wherein the enclosure is so designed as to be attractive and usable year round, and of such a design and construction that the same may permit easy opening and closing when desired by the building owner, yet of such a construction that the enclosure cannot be opened or removed by unauthorized entrants.

The prior art discloses various constructions and systems relating to enclosures for building openings and for fastening devices for such enclosures. Examples of such prior art teachings are disclosed in the U.S. Pat. No. 2,208,718; No. 2,222,667; No. 2,266,973; No. 2,631,698; No. 2,654,128; No. 2,716,783; No. 2,834,071; No. 3,028,638; No. 3,214,879; No. 3,305,623; No. 3,458,954; No. 3,591,992; No. 3,634,987; and United Kingdom Pat. No. 943,521.

SUMMARY OF THE INVENTION

The present invention which will be described subsequently in greater detail comprises a protective enclosure for building openings such as building windows and doors. The protective enclosure preferably comprises a peripheral frame member circumscribing the opening with the frame member having a Z-shaped cross section including first and second parallel walls connected by a transverse wall. The outer surface of each wall is adapted to abut a complementary shaped edge of the building opening. Suitable fastening means extend through the transverse wall into the building edges so as to secure the frame member to the building opening. A transparent shielding unit, which may be either a window or a door, is mounted into the frame such that the peripheral edges of the unit completely enclose the fastening means and prevent their withdrawal while the unit is in a closed position against the frame. The unit carries means for lockingly securing the unit to the frame from the inside of the window such that unauthorized entry into the building through the opening is completely eliminated.

It is therefore an object of the present invention to provide a protective enclosure for building openings, such as building windows and doors, which cannot be removed except from within the building after the shielding portion of the enclosure has been opened from within the building.

It is another object of the present invention to provide a window and door protective enclosure for a building that comprises substantially shatter-resistant and break-resistant transparent portions and cannot be removed by unauthorized persons.

Other objects, advantages, and applications of the present invention will become apparent to those skilled in the art of protective enclosures for building openings when the accompanying description of several examples of the best modes contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and in which.

DESCRIPTION OF THE PREFERRED EMBODIMENTS

Figure 1:
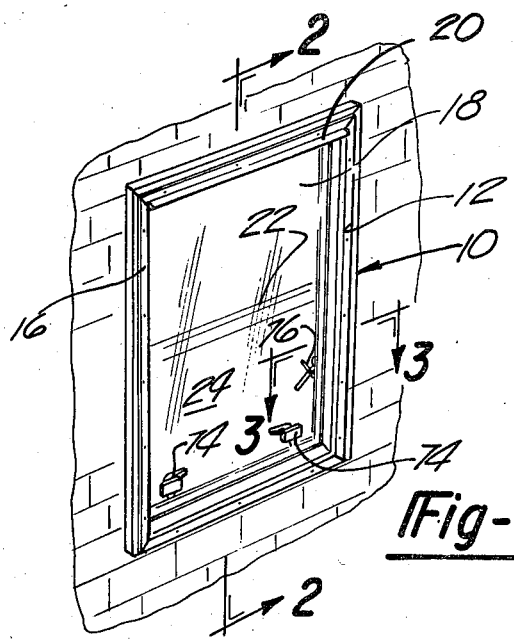
FIG. 1 is a perspective view of a protective enclosure for a building window.
Figure 2:
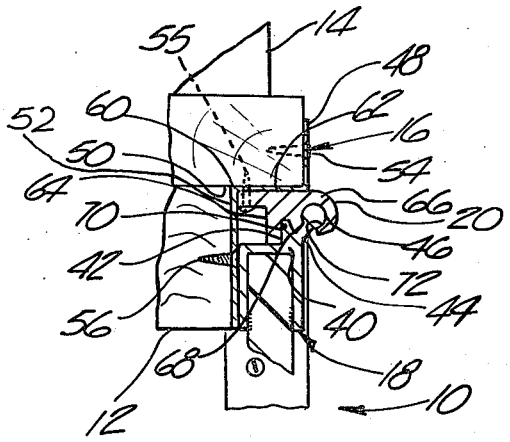
FIG. 2 is a fragmentary cross-sectional view of the protective enclosure taken along Line 2—2 of FIG. 1.
Figure 3:
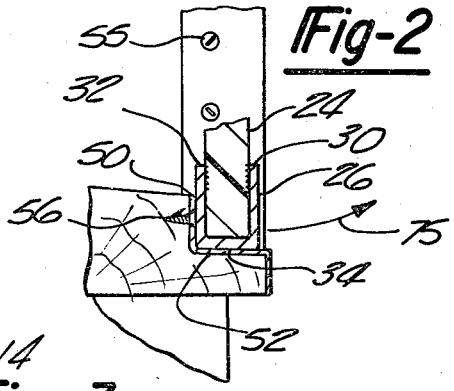
FIG. 3 is a fragmentary cross-sectional view of the protective enclosure taken along Line 3—3 of FIG. 1.
Figure 3:
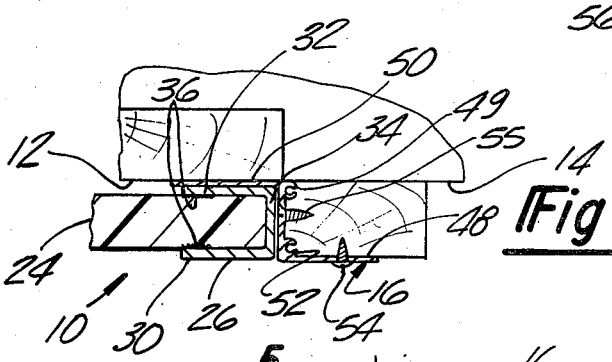

Referring now to the drawings and, in particular, to FIGS. 1, 2, and 3 wherein there is illustrated one example of the present invention in the form of a protective enclosure 10 for a window opening 12 of a building 14. The window enclosure 10 comprises a peripheral Z-shaped frame member 16 and a window unit 18 which is hinged to the frame member 16 by means of hinge 20. The window opening or casement structure 12 is rectangular in shape and fixed to the building siding by any suitable fastener, and typically the casement, or window opening, 12 comprises four boards arranged in an open rectangular frame and in which a conventional window, such as the double-hung window 22, is mounted. It is obvious that it is a relatively simple matter for a determined burglar to simply break the relatively non shatter-resistant glass contained within the conventional window 22.

The window unit 18 camprises a window portion 24 enclosed in a window frame structure 26. The window portion 24 is fabricated from a substantially shatter-resistant transparent plastic material, such as a high shatter-resistant Plexiglass or plastic glazing such as LEXAN. LEXAN is a trademark applied by the General Electric Company of Pittsfield, Mass., to transparent safety glazing for use in buildings, while Plexiglass is a trademark owned by the Rohm and Haas Company of Philadelphia, Penn., and is applied to transparent safety glazing for industrial and architectural applications. LEXAN and Plexiglass are examples of preferred materials for use in the construction of applicant's invention; however, it should be understood that other thermoplastic-type polymers and other suitable plastic material may be utilized in the construction of applicant's invention.

The window frame structure 26 comprises four channel members which are shown in cross section in FIGS. 2 and 3. Each of the channel members has leg members 30 and 32 extending from a base portion 34. Near the ends of the leg members 30 and 32 the opposite opposing inner surfaces are provided with a plurality of inwardly extending ridges and valley portions which function to provide sharp grasping surfaces 36 which engage the outer surface of the glazing material when the same has been inserted between the legs 30 and 32 of the frame to insure a firm grip of the window 24. The four channels of the frame structure 26 have 45° beveled end portions to provide a mating arrangement at each end and form the four corners of the resultant frame structure 18 to enclose the window 24. As can best be seen in FIG. 2, the top channel member includes a lengthwise integrally formed Y-shaped hinge member 40, one leg 42 of which is disposed in a vertical position for a purpose to be described hereinafter, while the other leg 44 terminates in a circular bearing joint 46 that extends the full width of the frame member 26. The circular joint 46 forms one portion of the hinge member 20 and will be described in greater detail hereinafter.

The frame structure 16 comprises four Z-shaped panels having their ends beveled at 45° to permit the panels or frame members 16 to be joined and form a rectangular opening that is sized to fit within a complementary shaped Z recess in the casing 12 of the window opening. Each Z-shaped frame member 16 has parallel walls 48 and 50 which are connected by transverse wall 52. The Z-shaped frame 16 is attached to the casing by means of a plurality of threaded fasteners 54, 55, and 56 which, respectively, extend through the walls 48, 52, and 50 of the Z-shaped frame member 16 to securely attach the frame member to the casement 12. The fasteners 54 extending through the outer wall 48 of the Z-shaped frame member 16 are tamper-proof screws requiring a special tool to remove them from the casement and may be of the type of screw which is disclosed in the aforementioned U.S. patent application. The screws 55 disposed along the top of the casement in addition to providing a means for attaching the wall surface 52 to the casement 12 extend through a horizontal arm 60 of the upper portion 62 of the hinge member 20 to firmly secure the hinge member portion 62 to the casement.

The hinge portion 62 is provided with a vertical arm 64 and an outwardly spaced curved arm 66 that cooperate with each other and a V-shaped notch 68 to define spaced recesses 70 and 72. The recess 72 is circular in shape extending the full length of the hinge portion 62 and pivotally receives the circular joint member 46 so as to pivotally connect the window portion 18 to the upper hinge member 62 and thus to pivotally connect the window to the Z-shaped frame 16. The vertical leg member 42 of the window 18 is adapted to be received in a mating, locking engagement within the recess 70 such that when the window is in the closed position illustrated in FIG. 2, the window is lockingly secured within the hinged member, and its outward removal therefrom is prevented.

It can also be seen from FIGS. 2 and 3 that when the window is pivoted to its closed position, as illustrated, the window and its side frame 18 completely enclose the screws 55 and 56 thereby preventing the removal of the frame and therefore the entire enclosure 10 from the window when the window is in the closed position even if a burglar can remove the special tamper-proof screws 54 from outside.

The window 10 is further provided with hinge or latch members 74 carried by the lower or bottom window frame portion and which are provided with suitable latching means to engage the backside of the lower frame wall 50 so that the window may be locked in a closed position to prevent entry and the removal of the window. Similarly, a suitable mechanism 76 may be provided to hold the window open in a selected position after the latches 74 have been opened and the window pivoted outwardly in the direction of the arrow 75, illustrated in FIG. 2.

It can be appreciated that the present example of the window enclosure 10 is illustrated as being positioned in front of a double-hung type window; however, it should be understood that the basic inventive concepts may be employed for use with different types of window openings such as slider, double-hung, casement, steel, aluminum, and wooden windows.

Figure 4:
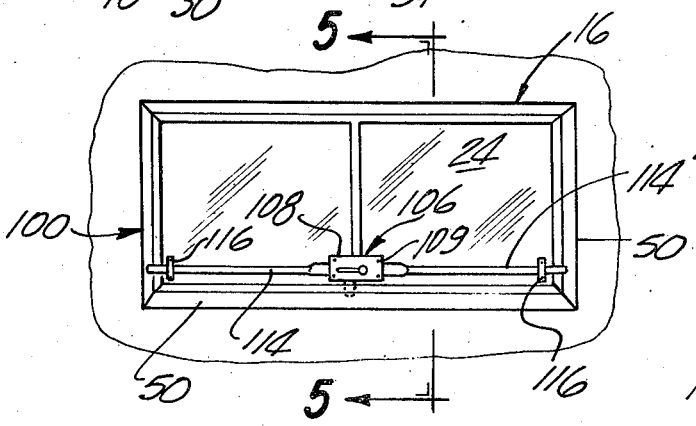
FIG. 4 is an interior view of a basement window employing a protective enclosure constructed in accordance with the principles of the present invention.
Figure 5:
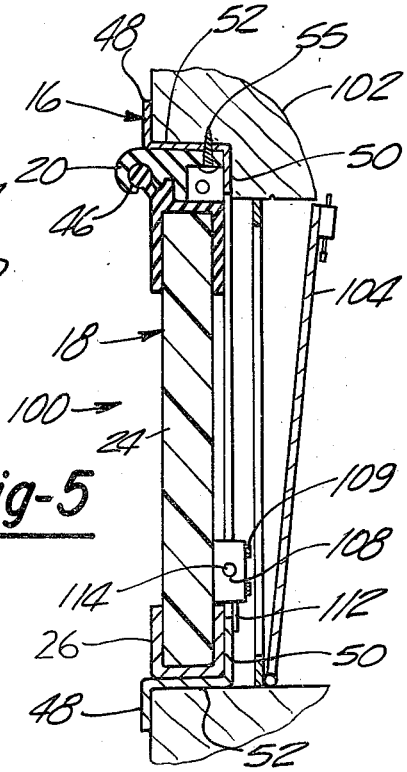
FIG. 5 is a fragmentary cross-sectional view of the protective enclosure taken along Line 5—5 of FIG. 4.

Another example of an application of the inventive enclosure is illustrated in FIGS. 4 and 5 wherein the enclosure is in the form of a basement window enclosure 100. The enclosure 100 is fabricated in a manner similar to the aforementioned window enclosure 10, in that it is provided with a Z-shaped frame 16 that is attached to a complementary shaped portion of the casement 102 of the basement window 104. The enclosure 100 further comprises a hinge portion 20 that permits the pivotal movement of the window unit 18 inwardly and outwardly as desired. The unit 18 further comprises the shatter-resistant window portion 24 enclosed by the window frame structure 26 in the same manner as described hereinbefore with respect to the embodiment illustrated in FIGS. 1, 2, and 3; and thus a further detailed descritpion of these common elements of the basement window enclosure 100 is not necessary.

Figure 6:
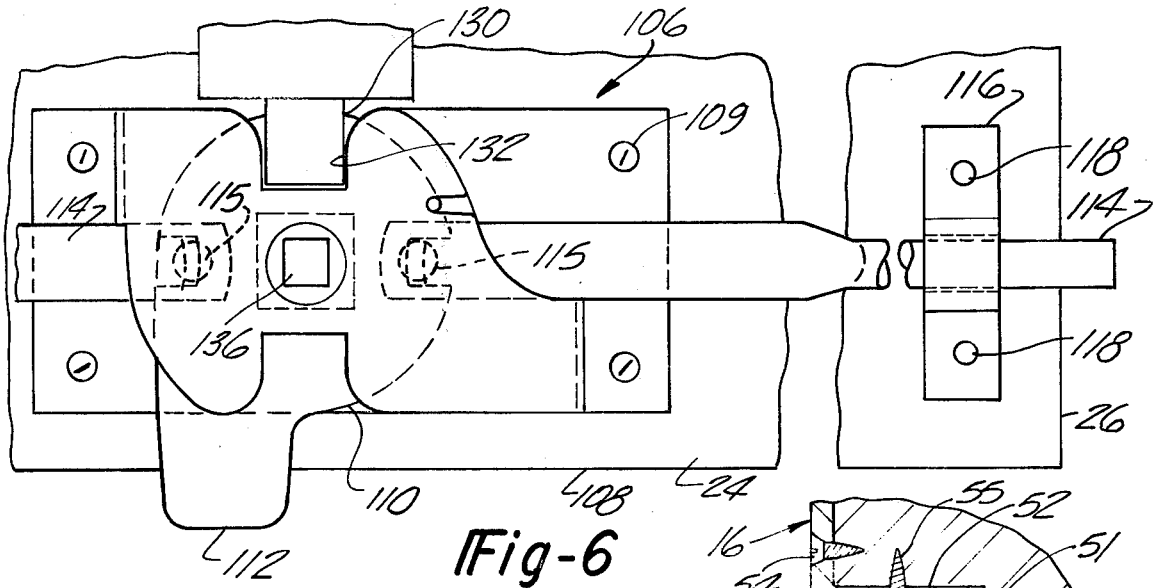
FIG. 6 is an enlarged fragmentary view of a locking mechanism utilized in conjunction with the protective enclosure illustrated in FIGS. 4 and 7.

The basement window enclosure 100 is maintained in a closed or locked position by means of a novel 3 point positive locking mechanism 106 which is illustrated in FIGS. 4, 5, and 6 as comprising a housing 108 which encloses the mechanism and which is fastened to the window 24 by any suitable means such as lock-type screws or fasteners 109 extending through the housing 106 and threadily engaging the inner surface of the window 24. The mechanism 106 further comprises a rotatable member 110 (FIG. 6) which includes a lower latching arm 112 that is adapted to engage the backside of the frame Z-bar inner wall 50 to prevent opening of the window. At the same time the rotating member 110 has movable arm members 114 which are pivotally attached to the member 110 at 115 and which may be retracted or extended depending upon the rotational position of the member 110. As can best be seen in FIGS. 4–6, when the member 110 is rotated so that its latch 112 is lockingly engaged with the frame 16 the arms 112 are extended outwardly and extend beyond the outer edges of the window 24 to lockingly engage the backside of the frame member 50 and prevent the opening of the window 24. U-shaped clamping members 116 are provided to slideably support the outer ends of the arms 114 and the clamping members 116 may be attached to the window by any suitable fasteners 118 extending therethrough and into a threaded engagement with the window 24.

Figure 8:
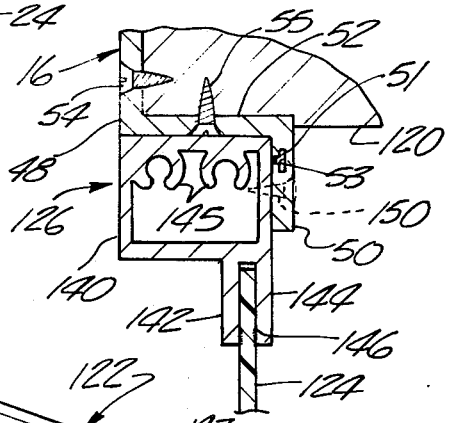
FIG. 8 is a fragmentary cross-sectional view through the protective door enclosure taken along Line 8—8 of FIG. 7 when the door is in a closed position.
Figure 7:
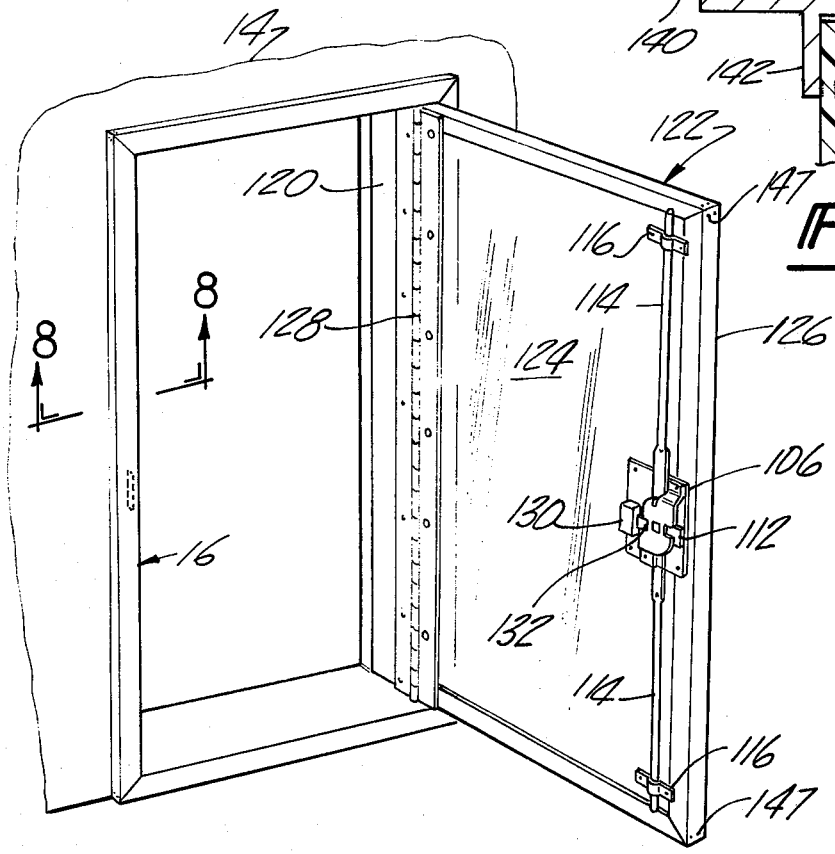
FIG. 7 is a perspective view of a protective enclosure in the form of a door for use in conjunction with a building doorway.

Referring now to FIGS. 7 and 8 wherein there is illustrated another example of the present invention wherein the same is utilized to enclose a doorway 120 of the building 14, and it is illustrated as comprising the Z-bar frame 16 which is attached to the doorway in the same manner as the Z-bar frame 16 is attached to the window casement in that a plurality of tamper-proof screws 54 extend through the outer wall 48 while screws 55 and 56 are provided to extend, respectively, through the transverse wall 52 and vertical wall 50 so as to positively and lockingly secure the frame member 16 to the doorway opening 120. The building doorway 120 can be enclosed by a protective door 122 which comprises a window 124 fabricated from a suitable shatter-resistant plastic material such as the aforementioned Plexiglass or LEXAN. The window 124 is enclosed by a framing member 126 which will be described in greater detain hereinafter. The framing member 126 is hinged at one edge by hinge element 128 to the doorway 120 such that the door may be opened and closed in a conventional manner.

The protective door 122 may be locked by means of the mechanism 106 which functions in a manner described hereinbefore and, additionally, includes a dead bolt arrangement 130 which is mounted to the housing 108 and which extends to the outside surface of the window 124 to permit insertion of a key, or the like, into the dead bolt lock such that the dead bolt 130 may be brought from a retracted to an extended position. As shown in FIG. 6, in the extended position the dead bolt 130 is received within a recess 132 formed within the rotatable member 110. Thus, when the rotatable member is in its locking position, that is, the latching portion 112 is extended beyond the outer periphery of the door and engaged behind the Z frame to lock the door shut and at the same time the arms 114 have been extended beyond the upper and lower edges of the door to likewise be positioned behind the frame 50 to insure the positive 3-point locking in the same manner as described hereinbefore with respect to the basement window 100. Additionally, the member 100 may be connected to a suitable shaft 136 (FIG. 6) that extends outwardly from the door to a conventional-type lock handle arrangement which may permit the opening and the closing of the latch 112 when the dead bolt is disengaged from the mechanism 110. Thus, entry into the doorway may be had by the proper utilization of keys to unlock both the dead bolt and the hanole lock to thereby permit free rotation of the mechanism 110.

As can best be seen in FIG. 8, the frame portion 126 comprises an enlarged rectangular section 140 which has legs 142 and 144 that terminate in an edgewise opening that tightly receives the outer edge of the glass 124 wherein the aforementioned serrated surface 146 is provided to grasp and retain the outer edges of the window 124. The enlarged rectangular section 140 provides additional strength and rigidity to the door yet permitting the use of the door in conjunction with a window glazing 124 which is not more than ¼ inch in thickness. As can best be seen in FIG. 8, the door 122 may be utilized to permanently enclose a doorway by providing fastening members 150, as shown in fanthom lines in FIG. 8, that extend through the inside wall 50 of the Z-bar 16 and into the enlarged portion 140 of the frame whereby the door can be secured around its entire periphery to the Z-frame and permanently closed. Such protective enclosures would be employed where large picture windows are utilized and where entry into the building is not desired, but the protective features of the present invention are needed. The strength provided by the enlarged frame 140 provides for a suitable and attractive enclosure and which is adapted to enclose a large area.

Thus, it can be seen that the present invention provides a new and improved enclosure for windows and doors which provides for the advantages of security and protection for homes, office buildings, whether vacant or occupied, and which does not have any of the aforementioned disadvantages of the prior art protection systems; and thus provides increased security against break-ins and burglaries.

As can also be seen the present invention does not require the use of locks, bolts, or bars to effectively prevent the entry of an experienced, professional burglar. Because of its unique construction, and in particular the window structures and the use of the inventive and novel hinge 20, the units may be of the self-contained pre-hung type which may be installed on the exterior of a structure such as storm window frames and door frames are attached to the window and door jambs.

The inside wall surface of the rectangular section 140 is provided with integral bosses 145 (FIG. 8) which receive screws 147 (FIG. 7) to secure the vertical and horizontal sections to each other. Similar bosses 49 (FIG. 3) are located on the wall 52 of the Z-shaped frame member 16 for receiving screws (not shown) for attaching the frame members together. The wall 50 of the frame member 16 associated with both the door and window structures is provided with a slot 51 which receives a strip 53 which functions to insulate the window and door when they are closed.

It should also be noted that because of the present inventive construction and design, existing windows and doors are completely unaffected by the installation of applicant's inventive protective enclosure; yet at the same time a positive locking and secure system is provided for preventing an unauthorized entry into such buildings and dwelling units.

Although only three forms of the present invention have been disclosed, it should apparent to those skilled in the art of protective enclosures that other forms may be had all coming within the spirit of the invention and scope of the appended claims.

What is claimed is as follows:

1. A protective enclosure for a building opening, said enclosure comprising:

a peripheral frame member circumscribing said opening, said frame member having a Z-shaped cross section including first and second parallel walls connected by a transverse wall, the inner surfaces of said walls adapted to abut a complementary shaped edge of said building openings;

first and second fastening means, respectively, extending through said transverse wall and said first wall for securing said frame member to said edge of said building opening;

a transparent shielding window unit comprising a peripheral metal member having an inner channel; and a transparent shielding material, the edges of which are mounted in said channel and enclosed by said peripheral member, said shielding material being fabricated from a plastic material of sufficient strength to prevent the breakage thereof by the application of a manual force, said transparent shielding window unit being carried by said frame and movable from a first opened position to a second closed position wherein the peripheral side edge of said metal member abuts said first wall to cover said second fastening means, and the peripheral bottom edge of said metal member snugly engages said transverse wall to cover said first fastening means;

locking means for securing said unit to said frame when said unit is in said closed position, said locking means being disposed on the inside surface of said frame and cooperating with said unit and said frame to prevent the opening of said unit;

hinge means extending along one edge of said unit for pivotally attaching said one edge of said unit to an edge of said frame member such that said unit may be moved toward and away from said frame member to open and close said building opening; said hinge means comprising:

a first element carried by said one edge of said frame and extending the full length of the adjacent edge of said unit, said first element having first and second spaced, lengthwise recesses;

a second hinge element integrally formed to the lengthwise edge of said unit, said hinge element having a pivot member of a circular configuration extending the full length thereof, said pivot member being pivotally received within one of said recesses to permit said unit to be pivoted with respect to said first hinge element; and said second hinge element having a second non-circular projection receivable in the other of said recesses to lockingly secure said unit to said hinge when said unit is pivoted toward said frame to enclose said fastening means.

2. The protective enclosure defined in claim 1 further comprising:

means for releasably locking said unit to said frame when said frame is pivoted to said closed position.

3. The protective enclosure defined in claim 2 wherein said locking means comprises:

a handle pivotally carried to the frame member of said unit;

said handle being pivoted from a first position wherein said handle engages the backside of said frame member to lockingly secure said window unit engaged with said frame member to a second position wherein said handle means is rotated such that said handle means is disengaged from said frame member such that said window unit may be pivoted outwardly from said frame; and means carried by said window and cooperating with said frame member to maintain said window in a selected open position.

4. The protective enclosure defined in claim 2 wherein said locking means comprises:

a rotatable member carried on the inside surface of said window unit and having a plurality of radially extending locking arms and movable from a position withdrawn from at least three of the outer edges of said window unit whereby said unit may freely be moved away from said frame unit to a second position wherein said arms extend over said three edges of said unit and engage the backside of said frame member to prevent said unit from being pivoted away from said frame member.

* * * * *